US011107347B2

(12) United States Patent
Malkes et al.

(10) Patent No.: US 11,107,347 B2
(45) **Date of Patent: *Aug. 31, 2021**

(54) ADAPTIVELY CONTROLLING TRAFFIC MOVEMENTS FOR DRIVER SAFETY

(71) Applicant: Cubic Corporation, San Diego, CA (US)

(72) Inventors: William A. Malkes, Knoxville, TN (US); William S. Overstreet, Knoxville, TN (US); Jeffery R. Price, Knoxville, TN (US); Michael J. Tourville, Lenoir City, TN (US)

(73) Assignee: Cubic Corporation, San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/395,088

(22) Filed: Apr. 25, 2019

(65) Prior Publication Data

US 2019/0333377 A1 Oct. 31, 2019

Related U.S. Application Data

(60) Provisional application No. 62/664,033, filed on Apr. 27, 2018.

(51) Int. Cl.

| | |
|---|---|
| ***G08G 1/087*** | (2006.01) |
| ***G08G 1/01*** | (2006.01) |
| ***G08G 1/04*** | (2006.01) |

(52) U.S. Cl.

CPC ..... *G08G 1/087* (2013.01); *G08G 1/0116* (2013.01); *G08G 1/0133* (2013.01); *G08G 1/0145* (2013.01); *G08G 1/04* (2013.01)

(58) Field of Classification Search

CPC ..... B60Q 1/26

See application file for complete search history.

(56) References Cited

U.S. PATENT DOCUMENTS

| | | | |
|---|---|---|---|
| 6,281,808 | B1 | 8/2001 | Glier et al. |
| 7,821,422 | B2 | 10/2010 | Hutchison et al. |
| 8,040,254 | B2 | 10/2011 | Delia et al. |
| 8,050,854 | B1 | 11/2011 | Chandra et al. |

(Continued)

FOREIGN PATENT DOCUMENTS

WO 2013/163203 A1 10/2013

OTHER PUBLICATIONS

International Search Report and Written Opinion dated Jul. 17, 2019 in related foreign application No. PCT/US2019/029710, 14 pgs.

*Primary Examiner* — Nabil H Syed
*Assistant Examiner* — Cal J Eustaquio
(74) *Attorney, Agent, or Firm* — Kilpatrick Townsend & Stockton, LLP

(57) ABSTRACT

A camera whose field of view includes an intersection of thoroughfares captures images and/or video of the intersection. Based on the captured images and/or video, a computer system surveys vehicular traffic through the intersection visible and defines both a risk zone of the intersection and a safe zone associated with the intersection. The computer system identifies that an at-risk vehicle is present in the risk zone and automatically modifying a timing of a traffic signal indicator to allow the at-risk vehicle to pass through the risk zone into the safe zone, for example by extending a green or yellow light.

18 Claims, 9 Drawing Sheets

(56) References Cited

U.S. PATENT DOCUMENTS

| | | | | |
|---|---|---|---|---|
| 2008/0094250 | A1* | 4/2008 | Myr | G08G 1/04 340/909 |
| 2009/0174573 | A1 | 7/2009 | Smith | |
| 2012/0033123 | A1 | 2/2012 | Inoue et al. | |
| 2015/0170498 | A1 | 6/2015 | Beggs et al. | |
| 2015/0243165 | A1 | 8/2015 | Elsheemy | |
| 2016/0027300 | A1 | 1/2016 | Raamot | |
| 2016/0097849 | A1 | 4/2016 | Nichols et al. | |

* cited by examiner

ADAPTIVELY CONTROLLING TRAFFIC MOVEMENTS FOR DRIVER SAFETY

CROSS-REFERENCE TO RELATED APPLICATIONS

The present disclosure claims the priority benefit of U.S. provisional application 62/664,033 filed Apr. 27, 2018 and titled "System and a Method of Adaptively Controlling Traffic Movements for Driver Safety," the disclosure of which is incorporated herein by reference.

BACKGROUND OF THE INVENTION

1. Field of the Disclosure

The present disclosure is generally related to traffic control systems, and more particularly related to adaptively controlling traffic movements for vehicular safety.

2. Description of the Related Art

Vehicular traffic on roads is essential for transportation of persons and goods. Typically, the vehicular traffic is controlled by using traffic signal indicators. The traffic signal indicators, and systems that control them, regulate flow of traffic on roads and intersections of roads. Generally, traffic lights are mounted on a traffic signal indicator present at an intersection, and may light up in a first color—typically green—to indicate that vehicles should go, in a second color—typically yellow—to indicate that vehicles should yield, and in a third color—typically red—to indicate that vehicles should stop. The traffic lights are used to regulate movement of traffic coming and going through all the roads. Cameras are sometimes also present at traffic lights, for example to photograph vehicles that run a red light.

Sometimes, conditions change quickly on the road or in an intersection. For example, a car may experience a flat tire, engine failure, or collision, forcing the car to severely slow down or come to a stop. If the car slows or comes to a stop in the middle of the intersection, this can lead to massive traffic buildup, especially if the light turns green immediately after for vehicles going in the a perpendicular direction to the direction the vehicle was traveling, forcing it to stop even if it was still moving at a slowed pace. This may force the car to stop in a more dangerous area—such as a higher-traffic area—than the car might have been able to stop if it had a little more time. There is currently no way for traffic control signals to adapt or react to ongoing developments such as these occurring at intersections or other road areas with traffic signal indicators.

DETAILED DESCRIPTION

A camera whose field of view includes an intersection of thoroughfares captures images and/or video of the intersection. Based on the captured images and/or video, a computer system surveys vehicular traffic through the intersection visible and defines both a risk zone of the intersection and a safe zone associated with the intersection. The computer system identifies that an at-risk vehicle is present in the risk zone and automatically modifying a timing of a traffic signal indicator to allow the at-risk vehicle to pass through the risk zone into the safe zone, for example by extending a green or yellow light.

Figure 1:
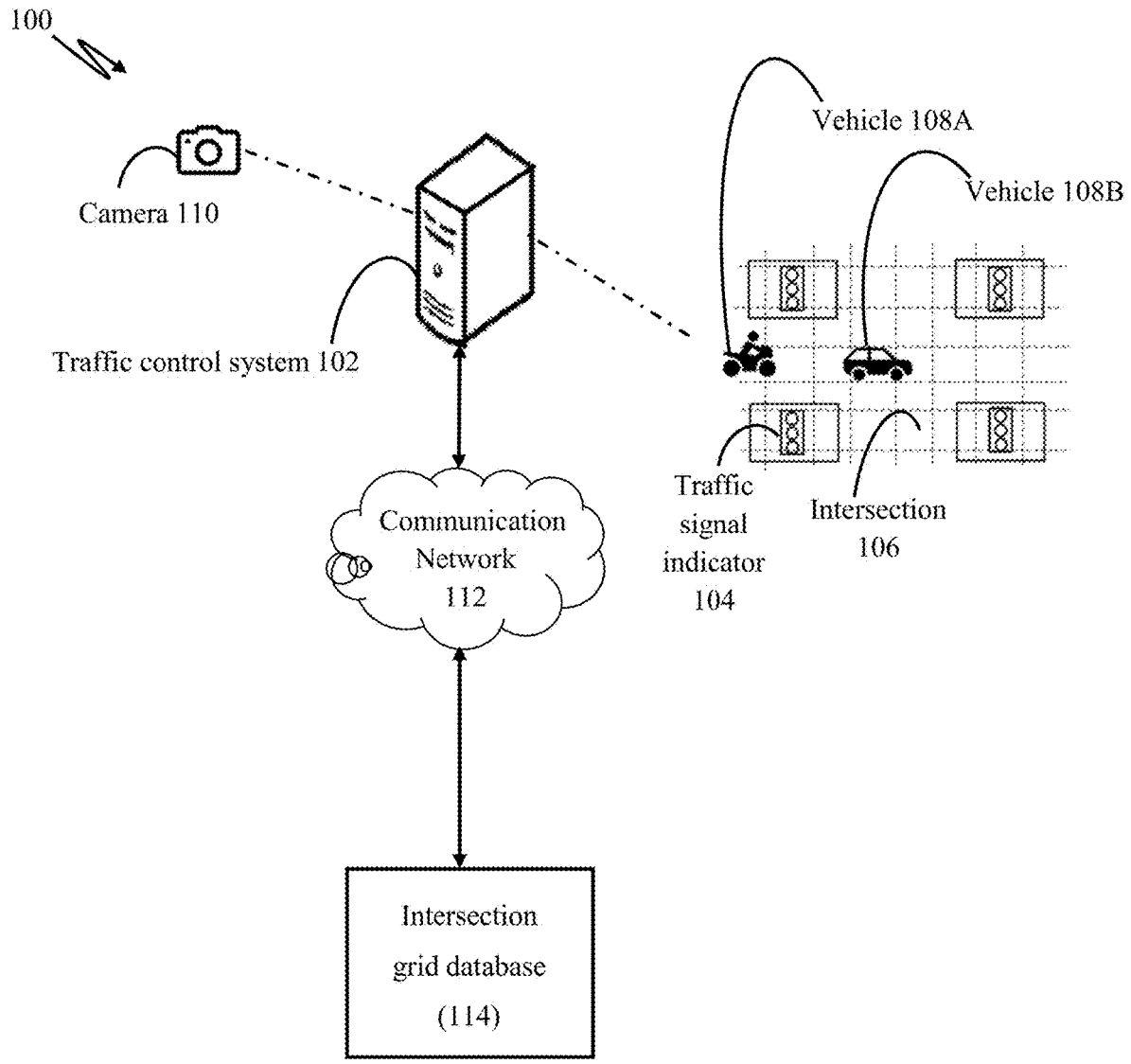
FIG. 1 is a network architecture diagram illustrating a traffic control system for adaptively controlling traffic signaling to assist at-risk vehicles.

FIG. 1 is a network architecture diagram illustrating a traffic control system for adaptively controlling traffic signaling to assist at-risk vehicles.

The traffic control system 102 of FIG. 1 is illustrated as connected to or coupled to a camera 110 and connected to or coupled to a traffic signal indicator 104 located within an intersection 106 of thoroughfares through which a first vehicle 108A (a car) and a second vehicle 108B (a motorcycle) are driving. The thoroughfares of FIG. 1 are roads (e.g., streets, avenues, boulevards, highways, freeways), but in other cases, the thoroughfares may be pedestrian paths, bike paths, waterways, railways, or airways.

The traffic control system 102 adjusts timings of one or more traffic signal indicators 104 at an intersection 106 if an at-risk vehicle 108 is detected in images or video captured by a camera 110 to be present at a region around an unsafe or risky zone of intersection 106, for example if a car accident occurs in the center of an intersection or if a vehicle stops on a crosswalk. The at-risk vehicle 108 may be in a place in which it is a risk is posed to the vehicle 108 itself, such the center of an intersection at which the vehicle 108 is at risk that oncoming traffic will hit the vehicle 108—or in a place in which the vehicle 108 is a risk to other vehicles or bikers or pedestrians or animals, such as a crosswalk or bike lane or animal crossing—or some combination thereof. In one case, apart from at-risk vehicle 108, other objects such as pedestrians, vehicles, animals, and other foreign objects may also be identified. Further, the traffic control system 102 may be connected to a communication network 112 for communicating data with an intersection grid database 114.

Figure 2:
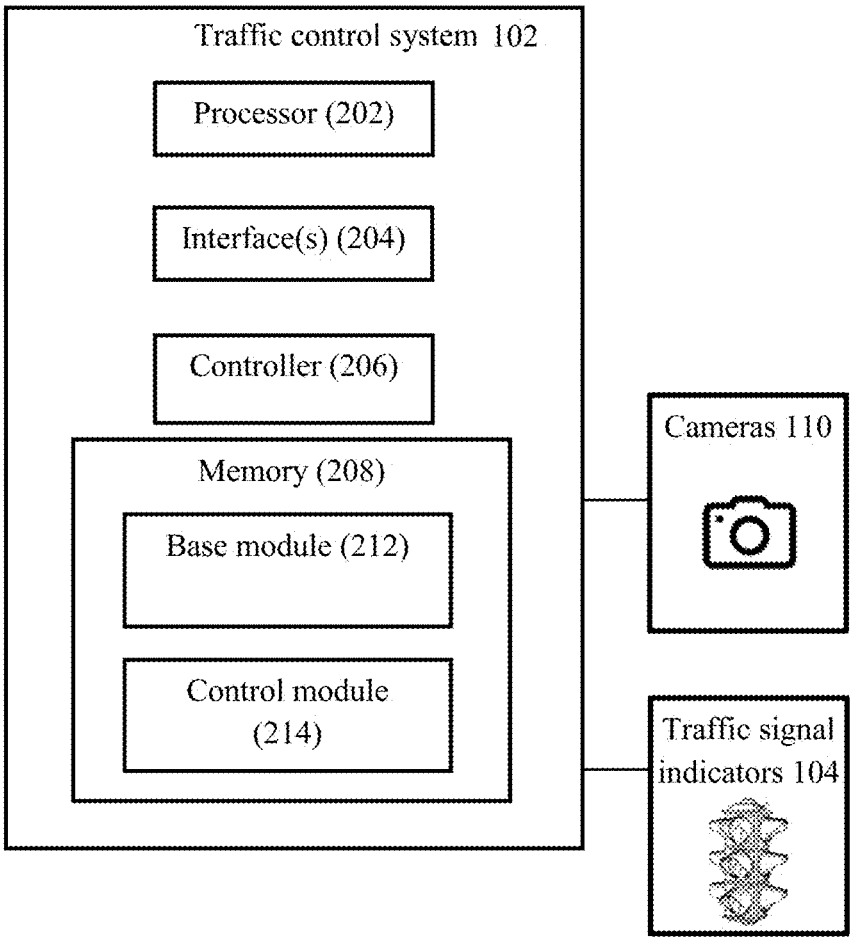
FIG. 2 is a block diagram illustrating components of the traffic control system.

The traffic control system 102 may utilize one or more cameras 110 for surveying vehicular traffic through the intersection 106 and detecting the at-risk vehicle 108. While the term "camera 110" in FIG. 1 and FIG. 2 is singular, it should be understood to refer to one or more cameras 110. Any of the cameras 110 may be visible light cameras, infrared/thermal cameras, ultraviolet cameras, cameras sensitive to any other range along the electromagnetic spectrum, night vision cameras, or a combination thereof. The cameras 110 may also include range measurement devices, such as light detection and ranging (LIDAR) transceivers, radio detection and ranging (RADAR) transceivers, electromagnetic detection and ranging (EmDAR) transceivers using another range along the electromagnetic spectrum, sound detection and ranging (SODAR) transceivers, sound navigation and ranging (SONAR) transceivers, or combinations thereof. Each camera 110 and/or range measurement device may be used to measure positions and/or speeds of vehicles along the thoroughfare(s) within a field of view of the respective camera 110 and/or range measurement device. A Visual Average Speed Computer And Recorder (VASCAR) sensor or other sensor for tracking locations and/or speeds of vehicles may also be used instead of or in conjunction with the camera 110. In some cases, each camera 110 may be a wide-angle lens camera, an omnidirectional camera, a fisheye camera, or some combination thereof.

The communication network 112 may be a wired and/or a wireless network. The communication network 112, if wireless, may be implemented using communication techniques such as Visible Light Communication (VLC), Worldwide Interoperability for Microwave Access (WiMAX), Long Term Evolution (LTE), Wireless Local Area Network (WLAN), Infrared (IR) communication, Public Switched Telephone Network (PSTN), Radio waves, vehicle-to-vehicle (V2V), vehicle-to-infrastructure (V2I), and/or infrastructure-to-vehicle (I2V) communications, dedicated short range communication (DSRC) wireless signal transfer, any communication technologies discussed with respect to the output devices 750 of FIG. 7, any communication technologies discussed with respect to the input devices 760 of FIG. 7, or any combination thereof.

FIG. 2 is a block diagram illustrating components of the traffic control system.

The block diagram of FIG. 2 shows different components of the traffic control system 102, including a processor 202, interface(s) 204, controller 206, and a memory 208. The controller 206 may be understood as a block executing certain functionalities of the processor 202. The traffic control system 102 of FIG. 1 and FIG. 2 as a whole may be and/or include a computing device 900 as illustrated in and discussed with respect to FIG. 7, or may include at least a subset of components of a computing device 700.

The traffic control system 102 is also shown coupled to one or more cameras 110 via one or more wired and/or wireless connections/connectors through which the traffic control system 102 can receive visual media data from a camera 110 such as images and/or videos and through which the traffic control system 102 can send data to the camera 110 to instruct the camera 110, for example to rotate or modify its zoom level to modify its field of view. The traffic control system 102 is also shown coupled to one or more traffic signal indicators 104 via one or more wired and/or wireless connections/connectors through which the traffic control system 102 can receive data from the traffic signal indicator 104 such as a current state (e.g., green light, yellow light, red light, error, off) or current timing schedule and through which the traffic control system 102 can send data to the traffic signal indicator 104 to instruct the traffic signal 104, for example to modify a timing schedule of the traffic signal indicators 104 to extend a light signal (e.g., green, yellow, red, error, off) or change a light signal from one of the possible traffic light signal outputs (e.g., green, yellow, red, error, off) to another one of the possible traffic light signal outputs.

The processor 202 may execute an algorithm stored in the memory 208 for adaptively controlling traffic movements, for driver safety. The processor 202 may also be configured to decode and execute any instructions received from one or more other electronic devices or server(s). The processor 202 may include one or more general purpose processors (e.g., INTEL® or Advanced Micro Devices® (AMD) microprocessors) and/or one or more special purpose processors (e.g., digital signal processors or Xilinx® System On Chip (SOC) Field Programmable Gate Array (FPGA) processor). The processor 202 may be configured to execute one or more computer-readable program instructions, such as program instructions to carry out any of the functions described in this description. The processor 202 may alternately or additionally be or include any processor 710 as illustrated in and discussed with respect to FIG. 7.

The interface(s) 204 may help an operator to interact with the traffic control system 102. The interface(s) 204 of the traffic control system 102 may either accept an input from the operator or provide an output to the operator, or may perform both the actions. The interface(s) 204 may either be a Command Line Interface (CLI), Graphical User Interface (GUI), or a voice interface. The interface(s) 204 may alternately or additionally be or include any input devices 760 and/or output devices 750 and/or display systems 770 and/or peripherals 780 as illustrated in and discussed with respect to FIG. 7.

The memory 208 may include, but is not limited to, fixed (hard) drives, magnetic tape, floppy diskettes, optical disks, Compact Disc Read-Only Memories (CD-ROMs), and magneto-optical disks, semiconductor memories, such as ROMs, Random Access Memories (RAMs), Programmable Read-Only Memories (PROMs), Erasable PROMs (EPROMs), Electrically Erasable PROMs (EEPROMs), flash memory, magnetic or optical cards, or other type of media/machine-readable medium suitable for storing electronic instructions. The memory 206 may alternately or additionally be or include any memory 720, mass storage 730, and/or portable storage 740 as illustrated in and discussed with respect to FIG. 7.

The memory 208 may comprise modules implemented as a program. In one case, the memory 208 may comprise a base module 212 and a control module 214.

In one embodiment, a traffic light 104 may be installed at an intersection 106, as shown in FIG. 1. The traffic light 104 may comprise lights positioned towards all lanes present at the intersection 106. The camera 110 used with the traffic control system 102 may capture video, and identify and track vehicles moving across the lanes. Further, multiple cameras may be used for tracking the vehicles in different lanes.

Figure 3:
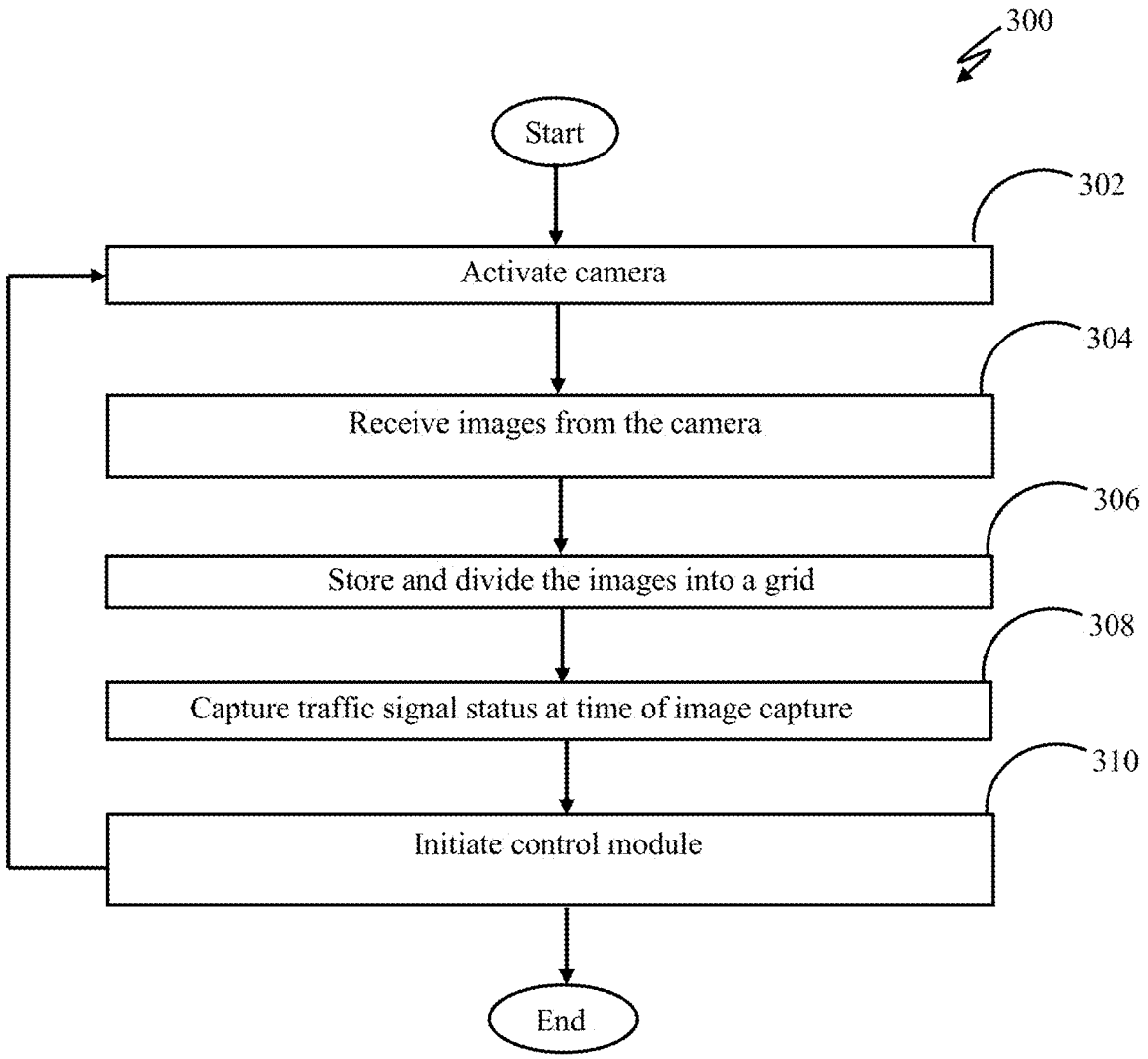
FIG. 3 is a flow diagram illustrating operations of a base module for visual media capture and analysis.

FIG. 3 is a flow diagram illustrating operations of a base module for visual media capture and analysis.

Operations identified in the flow diagram 300 of FIG. 3 may be performed by the base module 212 illustrated in FIG. 2. The camera 110 may be activated at step 302. The camera 110 may be installed to capture a video of vehicles moving across the lanes present at an intersection. In one case, the video may be used to identify the presence of a vehicle 108 moving across a lane at an intersection 106, and track the vehicle 108. The camera 110 used may include, but not limited to, fish-eye camera, closed circuit television (CCTV) camera, and infrared camera. Further, sensors such as induction loops may also be used along with the camera 110.

The base module 210 may receive images of the intersection from the camera 110, at step 304. The camera 110 may be positioned such that it may cover the complete intersection individually or cumulatively. Cumulative coverage of the intersection may be obtained by a stitched panoramic image of the intersection made using known methods existing in prior art.

Figure 6A:
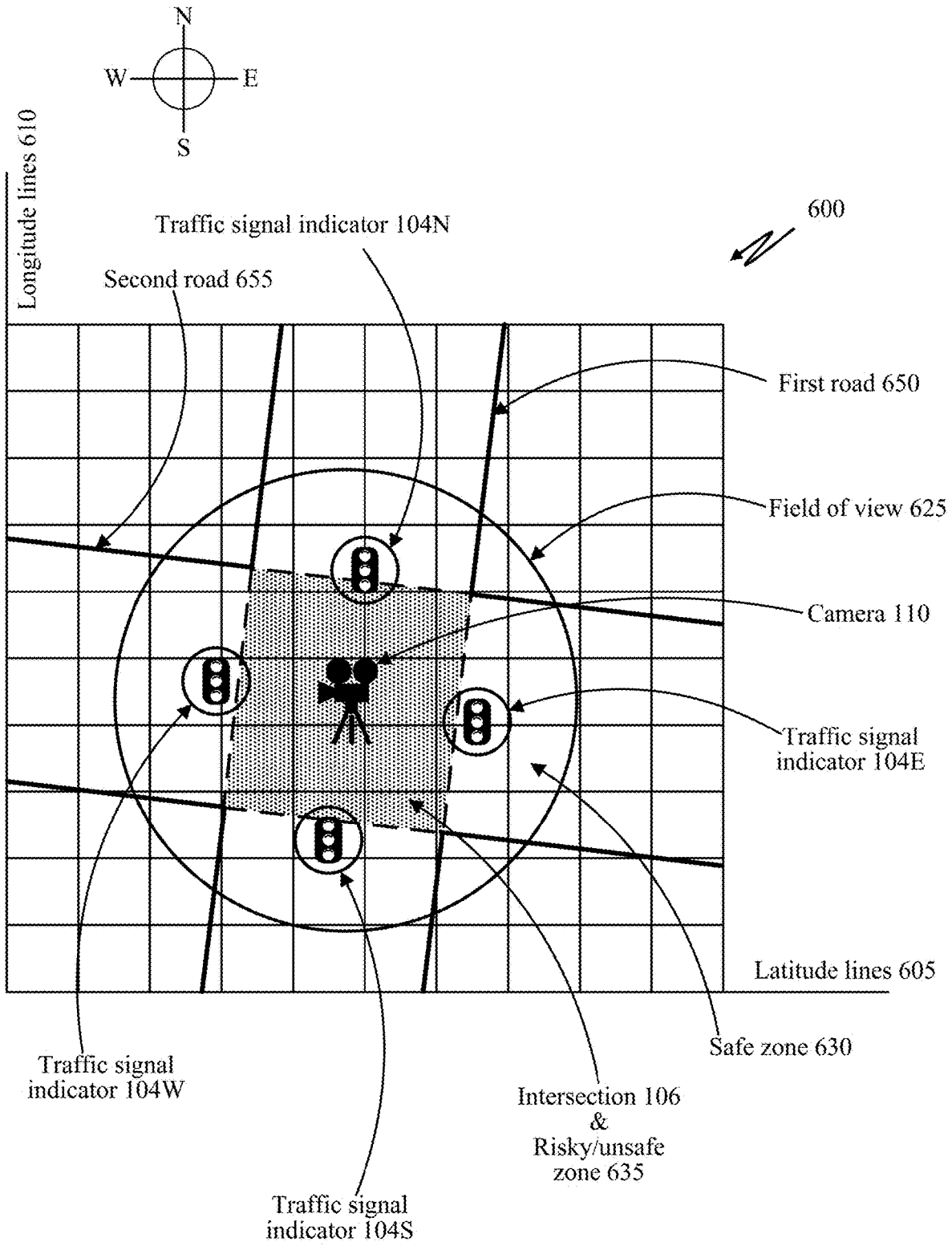
FIG. 6A illustrates an intersection with a camera, multiple traffic signal indicators, a defined risk zone, and a defined safe zone.
Figure 6B:
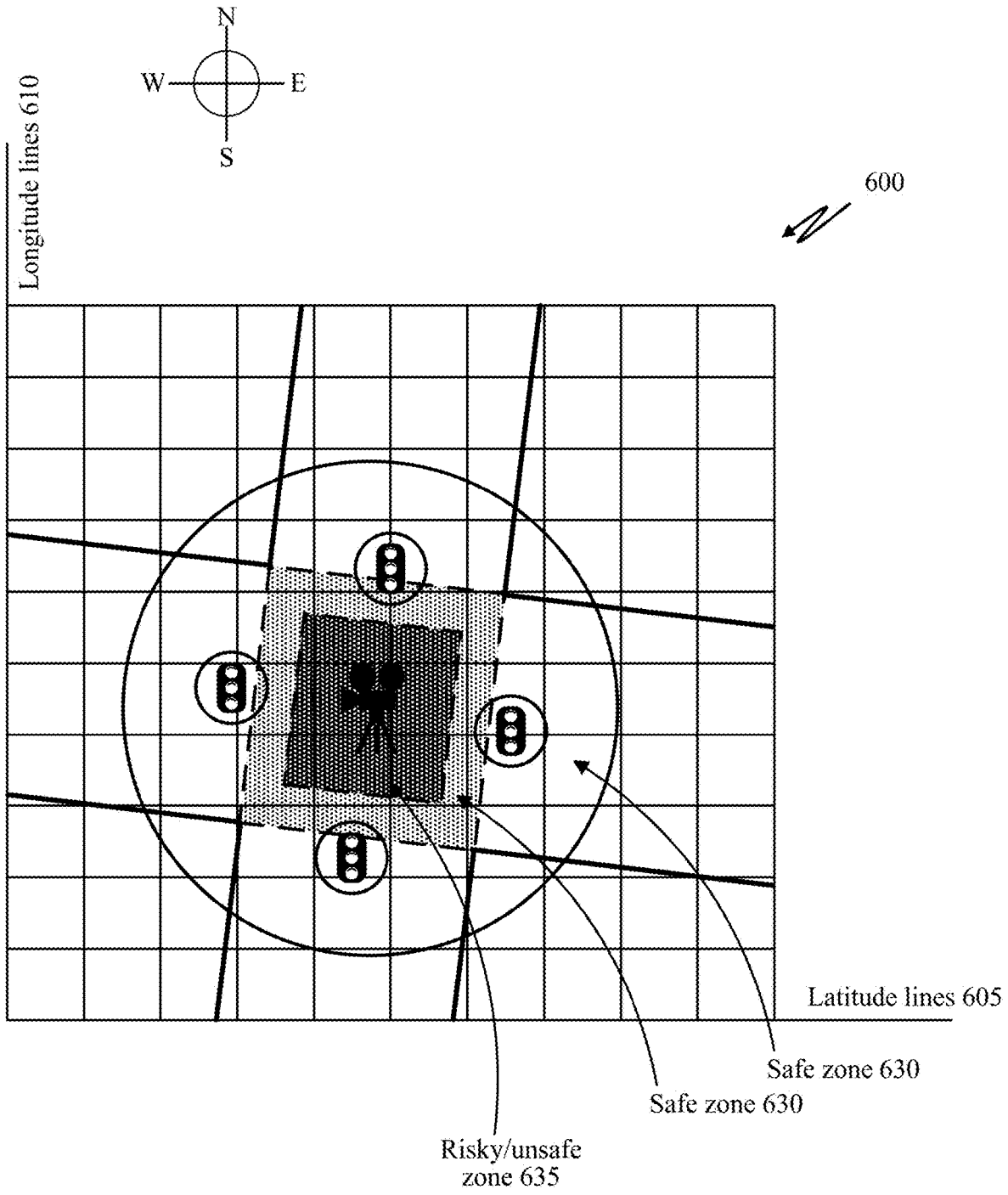
FIG. 6B illustrates the intersection of FIG. 6A with a different defined risk zone and a different defined safe zone than illustrated in FIG. 6A.

Further, the image of the intersection may be stored and divided into a grid, at step 306. The grid may comprise several grid areas or cells. The grid areas may be classified into inside cells and outside cells, based on pre-determined rules. In an exemplary embodiment, cells of the grid that lie on sidewalks or crosswalk may be classified as outside cells whereas cells of the grid lying in middle of the intersection may be classified as inside cells. Such classification may be stored as reference data in the intersection grid database 114. Creation of reference data may be a onetime calibration activity. An example grid 600 is shown in FIG. 6A and FIG. 6B, which is based on latitude lines 605 and longitude lines 610.

Successively, traffic signal status may be captured, at step 308. The traffic signal status may be determined based on active LED color of the traffic light 104—for example, red, green, yellow, error (flashing red), or off (disabled entirely)—at a time of capturing the image. Preferably, analysis of the image may be used to detect the traffic signal status by analyzing the active LED color from the image, for example based on red, green, and blue (RGB) or hex color values extracted from the image and identifying whether those most closely correspond to green, yellow, red, or any other color output by the traffic signal indicator 104. Also, the traffic light status may be obtained from the controller 206, which may maintain a log of phase change of the traffic signal in its local memory, or store the same on the cloud. The traffic status data may be stored on the intersection database 114 along with the image and the timestamp. The base module may initiate the control 214 module, at step 310.

Figure 4A:
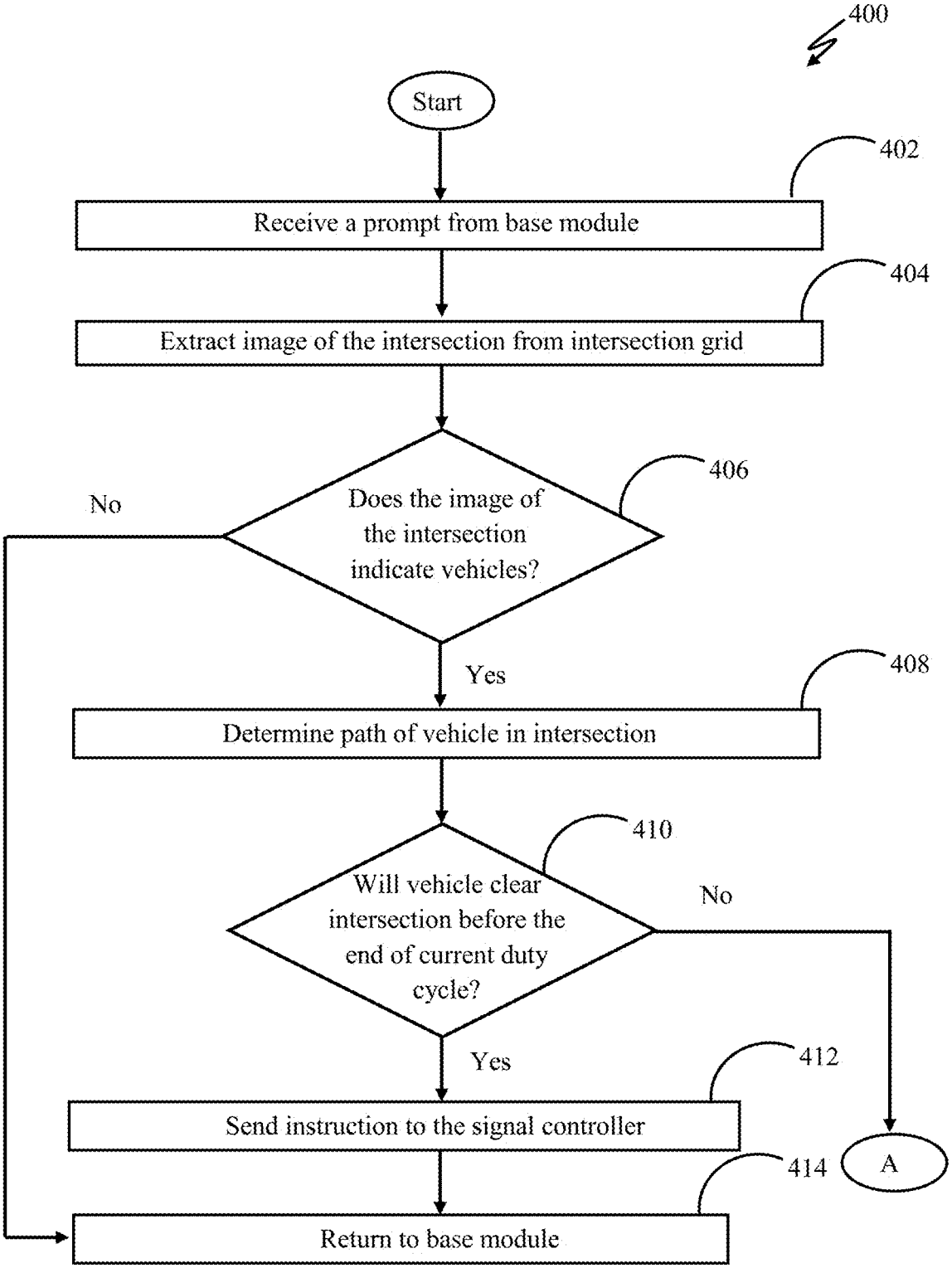
FIG. 4A is a first portion of a flow diagram illustrating operations of a control module for image analysis and vehicle tracking.

FIG. 4A is a first portion of a flow diagram illustrating operations of a control module for image analysis and vehicle tracking.

Figure 4B:
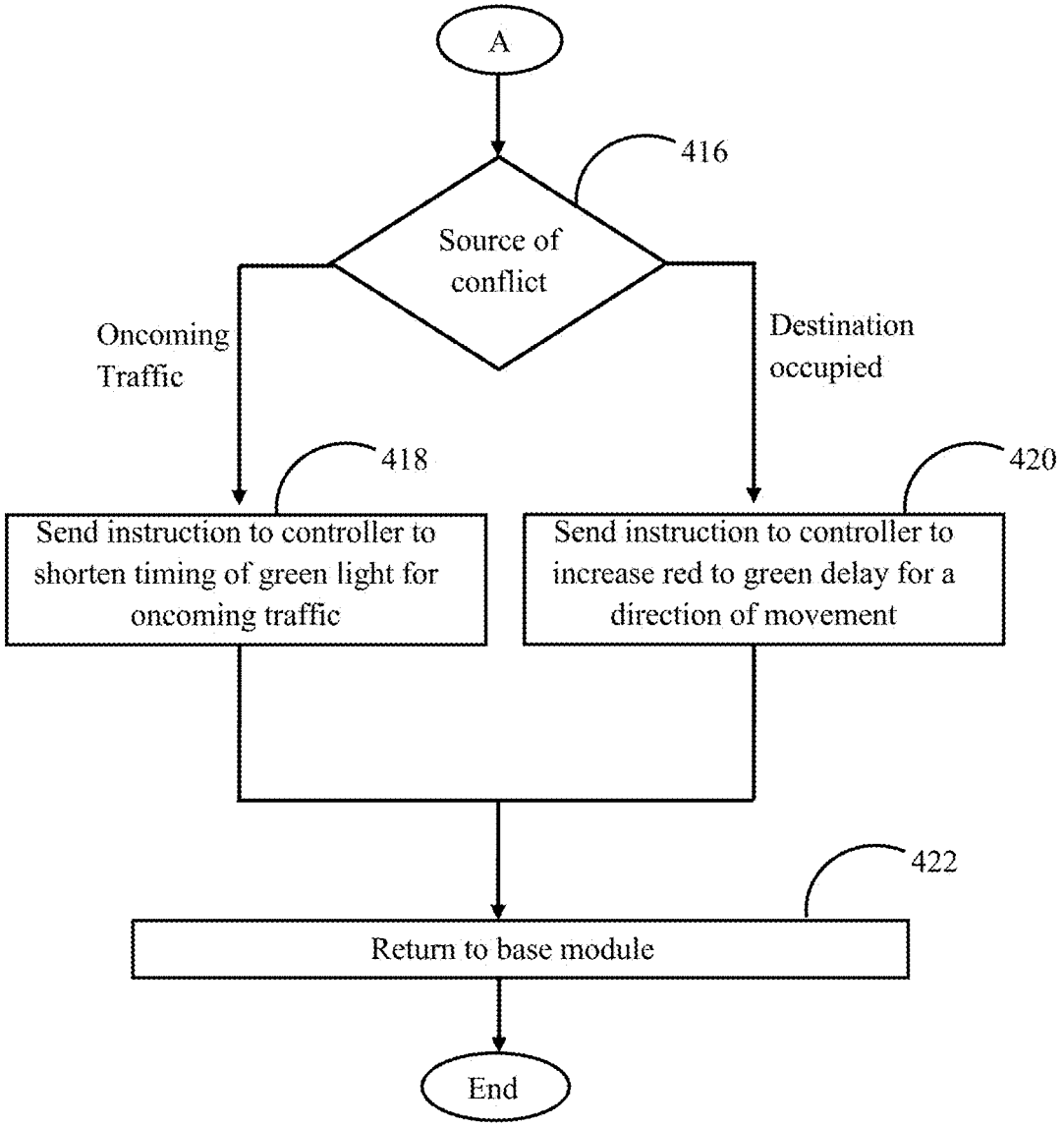
FIG. 4B is a second portion of the flow diagram of FIG. 4A illustrating operations of a control module for image analysis and vehicle tracking.

Operations identified in the flow diagram 400 of FIG. 4A and FIG. 4B may be performed by the control module 214 illustrated in FIG. 2. A prompt may be received from the base module 212 at step 402. The control module 214 may poll the images received from the camera 110 to recognize the object detected in the image. In another case, the object may be recognized to be the vehicle 108, based on image processing algorithms, at step 406. In one case, while the object is not identified as the vehicle 108, the control may be transferred to the base module 212, at step 414. In another case, while the vehicle 108 is identified as the object, a path of travel of the vehicle 108 may be determined, at step 408.

Successively, the path of travel of the vehicle 108 and position of the vehicle 108 in terms of the grid cell may be stored. The system may determine if the vehicle could clear the intersection before end of a current duty cycle of the traffic signal 104, at step 410. In another case, while it is determined that the vehicle 108 may clear the intersection before end of the current duty cycle, an instruction may be sent to the controller 206, at step 412. Successively, control may be transferred to the base module 212.

FIG. 4B is a second portion of the flow diagram of FIG. 4A illustrating operations of a control module for image analysis and vehicle tracking.

While it is determined that the vehicle 108 may not be able to clear the intersection before end of the current duty cycle, a source of conflict may be determined at step 416.

In some cases, while an oncoming traffic is identified as source of the conflict, an instruction may be sent to the controller 206 to shorten timing of green light for oncoming traffic, at step 418. Successively, the system may return control to the base module 212, at step 422. In another case, while an occupied destination is identified as source of the conflict, another instruction may be sent to the controller 206 to increase delay of switching time between red light and green light, for a direction of movement, at step 420. Successively, the system may return control to the base module, at step 422.

In an exemplary embodiment, a series of images may be captured by the camera 110. The camera 110 may be installed to capture video, identify presence of the vehicle 108 moving across a lane, and track the vehicle. The camera 110 used may include, but not limited to, fish-eye camera, closed circuit television (CCTV) camera, and infrared camera. Further, sensors such as induction loops may also be used along with the camera 110. The images captured by the camera 110 may be analyzed to determine if the vehicle 108 is continuing straight, turning right, or turning left. Such analytics may help to determine if the vehicle 108 will clear the intersection 106 before the duty cycle of the light is complete. In one case, the vehicle 108 may be determined to be moving straight, at 20 mph, the roadway past the intersection in that area may not be blocked by another vehicle and the traffic light may remain green for 10 more seconds. Based on this data, the vehicle 108 may clear the intersection 106 before the traffic light changes from green to yellow, or to red. In such case, instructions may be sent to the controller to continue the traffic light cycle (duty cycle) as normal.

Alternately, the vehicle 108 may be determined to be turning left, the roadway past the intersection 106 in the area the vehicle 108 may be open, and oncoming traffic may be blocking the vehicle's path (identified as a conflict). If it is determined that the vehicle 108 may not clear the intersection, the conflict source may be identified. In such case, the oncoming traffic may be identified as the conflict. During such situation, instructions may be sent to the controller 206 to shorten duty cycle (ON time) of green light for oncoming traffic by 20%. In this manner, the oncoming traffic may be stopped earlier than the normal duty cycle would have, thus allowing the vehicle 108 to clear the intersection 106 before the cross traffic is allowed to leave, without shortening the duty cycle of the cross traffic (percentage value chosen arbitrarily for example purposes).

In one embodiment, multiple cars are identified to be present at the intersection, waiting to make a turn. It may be assumed that a single vehicle could safely exit the intersection between the light turning red and the cross-traffic light turning green. If the conflict is such that the road in the vehicle's direction is occupied, vehicle is making a left turn and the traffic prevents the vehicle from clearing the intersection, the duty cycle of the active traffic light may not be adjusted. Instead, delay in the red to green light for the cross traffic may be increased by 20% (percentage value chosen arbitrarily for example purposes).

Table 1, provided below, illustrates data stored in the intersection grid database 114. Column one represents unique intersection identifier. Column two represents a Traffic Signal ID for labeling the traffic signal out of a plurality of traffic signals positioned at the corresponding intersection. For example, NS represents traffic signal controlling the traffic in North-to-South direction. Column three represents a time stamp when the image of the intersection is captured. Column four represents the image data captured using the camera 110. Column five represents the status (red, yellow or green) of the traffic signal 104, represented by the Traffic Signal ID. Analysis of the image may be used to detect the traffic signal status by identifying color of the traffic light in the image. Also, traffic signal status may be obtained from the controller 206 which may maintain the log of the change of phases of the traffic signal 104 in its local memory or store the same on the cloud.

TABLE 1

| Intersection ID | Traffic Signal ID | Time Stamp | Image File | Traffic Light Status |
|---|---|---|---|---|
| X123 | NS | 10/14/2017 10:30:00 | Img1.dat | Red |
| X123 | NS | 10/14/2017 10:31:10 | Img1.dat | Yellow |
| X123 | NS | 10/14/2017 10:31:50 | Img1.dat | Green |
| X123 | EW | 10/14/2017 10:30:00 | Img2.dat | Yellow |
| X123 | EW | 10/14/2017 10:31:10 | Img2.dat | Green |
| . . . | . . . | . . . | . . . | . . . |
| H456 | NS | 10/14/2017 10:31:10 | ImgN.dat | Red |

Figure 5:
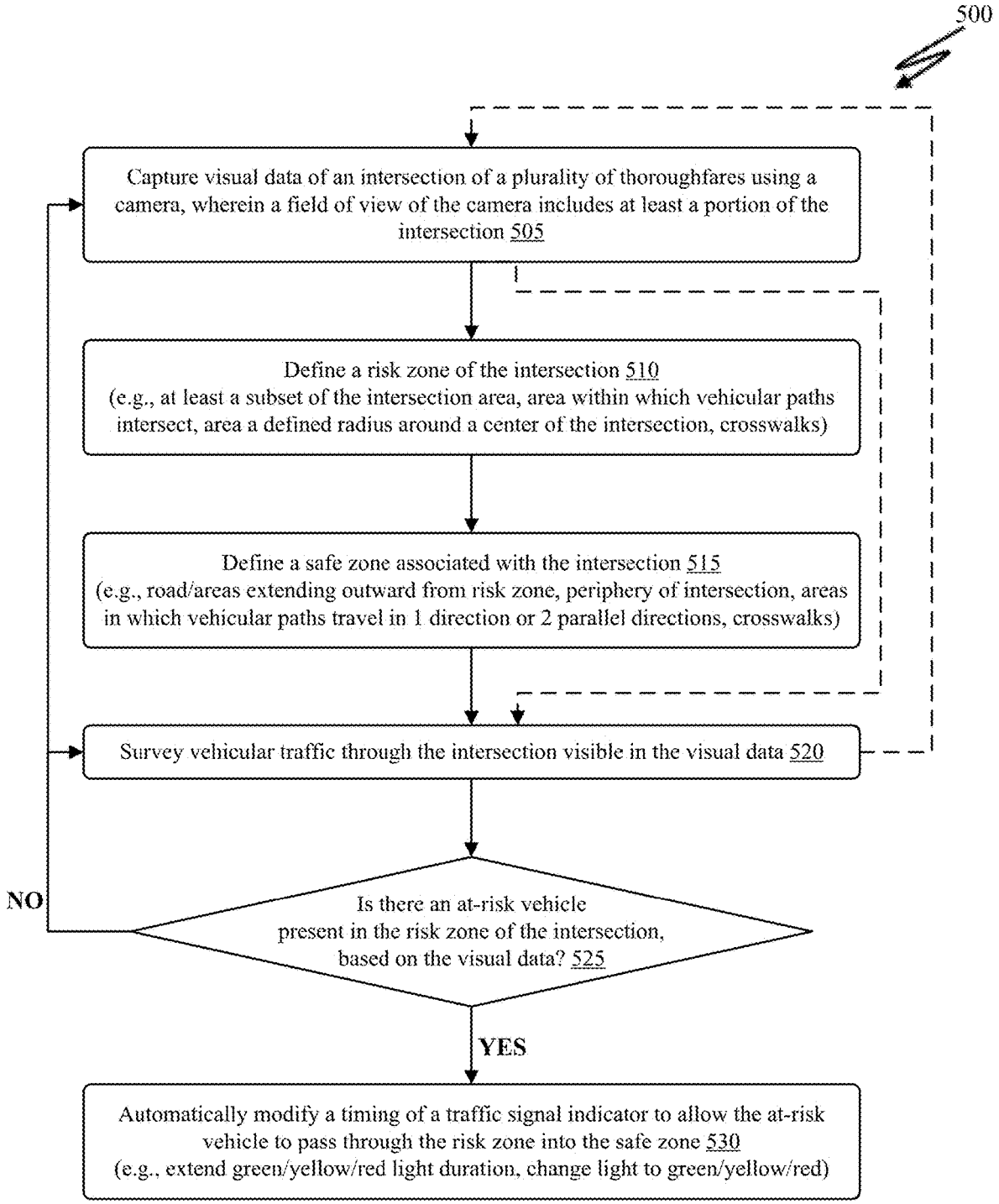
FIG. 5 is a flow diagram illustrating operations for adaptive control of traffic signaling to assist at-risk vehicles.

FIG. 5 is a flow diagram illustrating operations for adaptive control of traffic signaling to assist at-risk vehicles.

The flow diagram 500 of FIG. 5 shows the architecture, functionality, and operation for a traffic control system for adaptively controlling traffic signaling to provide pedestrian and vehicle safety.

At step 505, visual data of an intersection 106 of a plurality of thoroughfares is captured using a camera 110. A field of view of the camera includes at least a portion of the intersection The camera 110 used may include, but not limited to, fish-eye camera, closed circuit television (CCTV) camera, and infrared camera. Further, sensors such as induction loops may also be used along with the camera 110.

At step 510, one or more risk zones (or "risky" zones or "unsafe" zones) of the intersection 106 may be defined (traffic control system 102) based on the visual data of the intersection. Risk zones may be defined to be areas in which, if a vehicle 108 were to stop for an extended period of time or while the wrong traffic signal color light is output, the vehicle itself would be in danger of being hit (e.g., by other vehicles, bikes, pedestrians, or animals), and/or the vehicle might present a risk to other vehicles, bikes, pedestrians, or animals. For example risk zones may include at least a subset of the overlap or intersection area of two or more thoroughfares intersecting at an intersection 106, an area within which vehicular paths of vehicle traffic traversing the intersection 106 intersect with each other, an area defined as a pre-defined radius around a center of the intersection, an area of a crosswalk and/or around a crosswalk (where the vehicle's presence presents a risk to pedestrians), or some combination thereof.

Similarly, at step 515, one or more safe zones (or "non-risky" zones) of the intersection 106 may be defined (by the traffic control system 102) based on the visual data of the intersection. Safe zones may be defined to be areas in which, if a vehicle 108 were to stop for an extended period of time regardless of which traffic signal color light is output, the vehicle itself would likely not be in danger of being hit (e.g., by other vehicles, bikes, pedestrians, or animals), and/or the vehicle would likely not present a risk to other vehicles, bikes, pedestrians, or animals. For example, safe zones may include thoroughfares and/or areas extending outward from risk zone, an representing a periphery of the intersection 106 or included within and/or along a periphery of the intersection 106, areas within which vehicular paths typically (or are guided to) travel in one direction or in two directions that are parallel to each other, an area of a crosswalk and/or around a crosswalk (where the vehicle's presence does not present a risk to pedestrians), or some combination thereof.

In some cases, areas of a grid defined on the image may be classified into safe zones and unsafe zones based on pre-determined rules. Cells of the grid that may lie on sidewalks or crosswalks may be classified as outside or unsafe zones whereas cells of the grid lying in middle of the intersection may be classified as inside or safe zones. In some cases, cells lying on crosswalk or sidewalks may be considered as safe zone while cells lying in middle of the intersection may be considered as the unsafe zone.

At step 520, the traffic control system 102 may survey vehicular traffic through the intersection 106 that is visible in the visual data captured in step 505, and/or a specific vehicle 108 present on the intersection may be identified and tracked. The visual data from the camera 110 may be used to track and identify the vehicle 108 moving across lanes of the intersection, for example using image recognition and/or feature recognition to recognize and track the specific vehicle 108.

At step 525, the traffic control system 102 may identify whether or not there is an at-risk vehicle 108 present in the risk zone of the intersection 106 (or in some cases simply in the intersection in general) based on the visual data collected in step 505. That is, the traffic control system 102 may identify when an at-risk vehicle 108 may be in a place in which it is a risk is posed to the vehicle 108 itself, such the center of an intersection at which the vehicle 108 is at risk that oncoming traffic will hit the vehicle 108—or in a place in which the vehicle 108 is a risk to other vehicles or bikers or pedestrians or animals, such as a crosswalk or bike lane or animal crossing—or some combination thereof. In one case, apart from at-risk vehicle 108, other objects such as pedestrians, vehicles, animals, and other foreign objects may also be identified.

At step 530, the traffic control system 102 may automatically modify a timing of a traffic signal indicator to allow the at-risk vehicle 108 to pass through the risk zone into the safe zone 530, for example by extending green/yellow/red/error/off output durations, changing lights from one possible output (e.g., green, yellow, red, error, off) to another possible output (e.g., green, yellow, red, error, off). In some cases ON or OFF time of the traffic light may be extended. The ON or OFF time may be extended for a predefined period to allow the at-risk vehicle 108 to pass through the unsafe zone.

FIG. 6A illustrates an intersection with a camera, multiple traffic signal indicators, a defined risk zone, and a defined safe zone.

The intersection 106 illustrated in FIG. 6A is shown in the context of a location grid 600 that is defined using latitude lines 605 and longitude lines 610. The distance between each horizontal latitude lines 605 and between each vertical longitude lines 610 may be any distance, and in this case may for example be a less than ten meters or less than one meter.

The intersection 106 of FIG. 6A is an intersection of a first road 650 going roughly along a north-south axis with a slight northeast-southwest slant and a second road 655 going roughly along a east-west axis with a slight northwest-southeast slant. A camera 110 is shown in the center of the intersection 106. A field of view 625 of the camera 110 of FIG. 6A encompasses the entire intersection 106.

The intersection 106 of FIG. 6A includes four traffic signal indicators 104, including a north-positioned south-facing traffic signal indicator 104N on the first road 650, a south-positioned north-facing traffic signal indicator 104S on the first road 650, an east-positioned west-facing traffic signal indicator 104E on the second road 655, and a west-positioned east-facing traffic signal indicator 104W on the second road 655.

For the intersection 106 of FIG. 6A, the entire intersection 106 has been deemed to be a risk zone 635 and is shaded grey. The areas of the first road 650 and of the second road 655 that extend outward from the intersection 106 of FIG. 6A collectively represent the safe zone 630. This is because it is dangerous for a vehicle 108 to stay stopped in the risk zone 635/intersection 106, and it is safer (lower risk) for the vehicle 108 to stop away from the intersection in an area of the first road 650 or of the second road 655 not in the intersection 106.

FIG. 6B illustrates the intersection of FIG. 6A with a different defined risk zone and a different defined safe zone than illustrated in FIG. 6A.

The grid 600 and intersection 106 of FIG. 6B is the same as the grid 600 and intersection 106 of FIG. 6A, but the risk zone 635 and safe zone 630 are defined differently. Specifically, the risk zone 635—colored dark grey in FIG. 6B—includes the center of the intersection 106 as well as a box around the center of the intersection 106, the box not encompassing the entire intersection 106. The safe zone 630 includes the areas of the first road 650 and second road 655 identified in FIG. 6A as well as an area corresponding to the periphery of the intersection 106, colored light grey in FIG. 6B.

The risk zone 635 and safe zone 630 of FIG. 6B may have been defined in the way illustrated in multiple ways based on different possible criteria. For example, the dark grey risk area 635 of FIG. 6B may have been defined to represent a pre-defined percentage of the intersection area, for example 60%, 65%, 70%, 75%, 80%, 85%, 90%, or 95%, with the remainder being part of the light grey safe zone 630 instead. The dark grey risk area 635 of FIG. 6B may represent an area within which vehicular paths intersect—that is, paths of vehicles traveling along north-south paths across the first road 650 may intersect with paths of vehicles traveling along east-west paths across the second road 655 within the dark grey risk area 635 of FIG. 6B, with the remainder being areas that are typically only traversed by vehicles traveling only along a north-south path across the first road 650 or only along east-west paths across the second road 655. The dark grey risk area 635 of FIG. 6B may represent area a defined radius around a center of the intersection, which may be a circle or ellipse having that radius along at least one side of a square or rectangle having twice that predefined radius as the side of a side as in FIG. 6B, where any area outside that area is part of the light grey safe zone 630 instead. The light grey safe zone 630 may be a periphery of intersection of a predefined absolute width (e.g., 1 meter or 5 meters or 10 meters) or a predetermined relative width (e.g., 5% or 10% or 15% of each side of the intersection 106), with the area inside that periphery being part of the dark grey risk area 635 of FIG. 6B instead. The light grey safe zone 630 may be any road or other area extending outward from a risk zone 635. The light grey safe zone 630 may be any areas in which vehicular paths travel in one direction (e.g., north, south, east, west, or any direction in between) or two parallel directions (e.g., north-south as in the first road 650, east-west as in the second road 655, or any set of two parallel diagonal directions). Crosswalks, bike lanes, and/or animal crossings) may be either deemed a risk area 635 (because the vehicle 108 may pose a risk to pedestrians, bicyclists, and/or animals) or deemed a safe area 630 (because the vehicle 108 is likely safe from other vehicles 108 there). In the intersection 106 of FIG. 6B, crosswalks appear to have been deemed a light grey and/or white safe zone 630, the light grey or white depending on the whether the crosswalks are positioned just within the intersection 106, just along the outside of the intersection, or some combination thereof.

Figure 7:
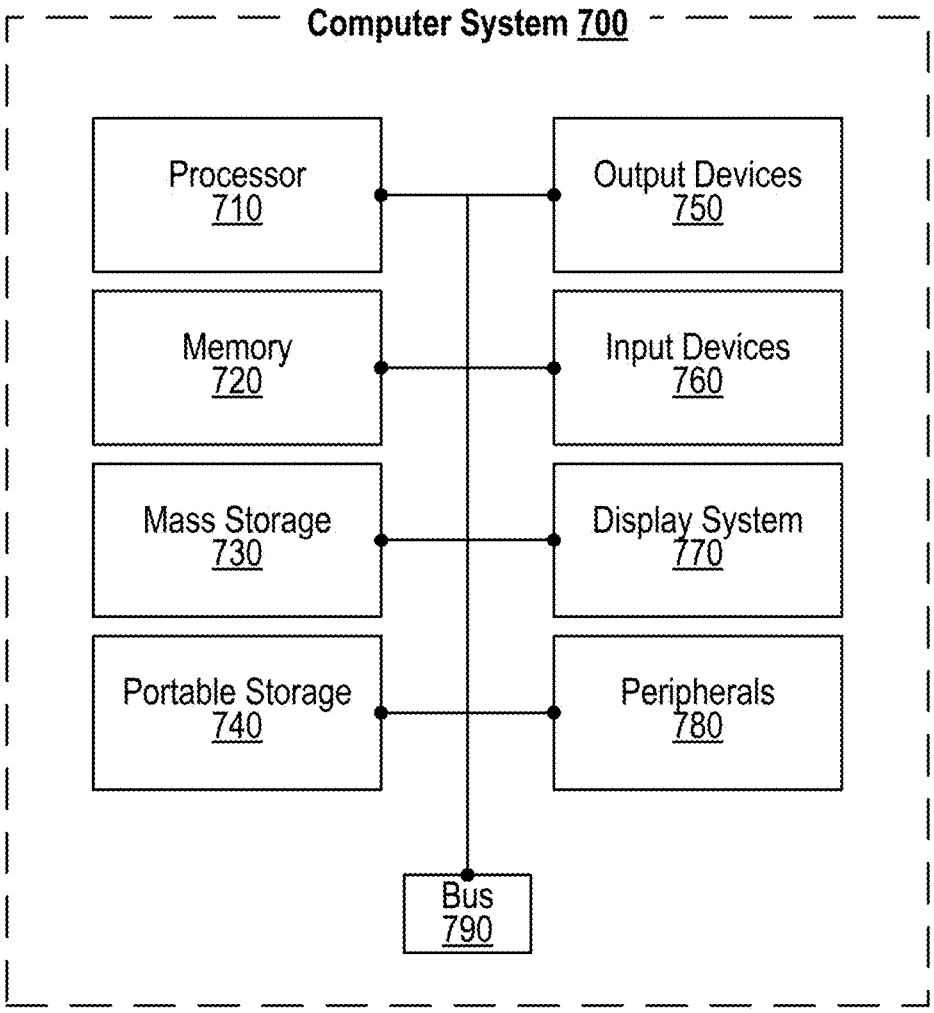
FIG. 7 is a block diagram of an exemplary computing device that may be used to implement some aspects of the adaptive traffic control technology

FIG. 7 illustrates an exemplary computing system 700 that may be used to implement some aspects of the adaptive traffic control technology. For example, any of the computing devices, computing systems, network devices, network systems, servers, and/or arrangements of circuitry described herein may include at least one computing system 700, or may include at least one component of the computer system 700 identified in FIG. 7. The computing system 700 of FIG. 7 includes one or more processors 710 and memory 720. Each of the processor(s) 710 may refer to one or more processors, controllers, microcontrollers, central processing units (CPUs), graphics processing units (GPUs), arithmetic logic units (ALUs), accelerated processing units (APUs), digital signal processors (DSPs), application specific integrated circuits (ASICs), field-programmable gate arrays (FPGAs), or combinations thereof. Each of the processor(s) 710 may include one or more cores, either integrated onto a single chip or spread across multiple chips connected or coupled together. Memory 720 stores, in part, instructions and data for execution by processor 710. Memory 720 can store the executable code when in operation. The system 700 of FIG. 7 further includes a mass storage device 730, portable storage medium drive(s) 740, output devices 750, user input devices 760, a graphics display 770, and peripheral devices 780.

The components shown in FIG. 7 are depicted as being connected via a single bus 790. However, the components may be connected through one or more data transport means. For example, processor unit 710 and memory 720 may be connected via a local microprocessor bus, and the mass storage device 730, peripheral device(s) 780, portable storage device 740, and display system 770 may be connected via one or more input/output (I/O) buses.

Mass storage device 730, which may be implemented with a magnetic disk drive or an optical disk drive, is a non-volatile storage device for storing data and instructions for use by processor unit 710. Mass storage device 730 can store the system software for implementing some aspects of the subject technology for purposes of loading that software into memory 720.

Portable storage device 740 operates in conjunction with a portable non-volatile storage medium, such as a floppy disk, compact disk or Digital video disc, to input and output data and code to and from the computer system 700 of FIG. 7. The system software for implementing aspects of the subject technology may be stored on such a portable medium and input to the computer system 700 via the portable storage device 740.

The memory 720, mass storage device 730, or portable storage 740 may in some cases store sensitive information, such as transaction information, health information, or cryptographic keys, and may in some cases encrypt or decrypt such information with the aid of the processor 710. The memory 720, mass storage device 730, or portable storage 740 may in some cases store, at least in part, instructions, executable code, or other data for execution or processing by the processor 710.

Output devices 750 may include, for example, communication circuitry for outputting data through wired or wireless means, display circuitry for displaying data via a display screen, audio circuitry for outputting audio via headphones or a speaker, printer circuitry for printing data via a printer, or some combination thereof. The display screen may be any type of display discussed with respect to the display system 770. The printer may be inkjet, laserjet, thermal, or some combination thereof. In some cases, the output device circuitry 750 may allow for transmission of data over an audio jack/plug, a microphone jack/plug, a universal serial bus (USB) port/plug, an Apple® Lightning® port/plug, an Ethernet port/plug, a fiber optic port/plug, a proprietary wired port/plug, a BLUETOOTH® wireless signal transfer, a BLUETOOTH® low energy (BLE) wireless signal transfer, an IBEACON® wireless signal transfer, a radio-frequency identification (RFID) wireless signal transfer, near-field communications (NFC) wireless signal transfer, dedicated short range communication (DSRC) wireless signal transfer, 802.11 Wi-Fi wireless signal transfer, wireless local area network (WLAN) signal transfer, Visible Light Communication (VLC), Worldwide Interoperability for Microwave Access (WiMAX), Infrared (IR) communication wireless signal transfer, Public Switched Telephone Network (PSTN) signal transfer, Integrated Services Digital Network (ISDN) signal transfer, 3G/4G/5G/LTE cellular data network wireless signal transfer, ad-hoc network signal transfer, radio wave signal transfer, microwave signal transfer, infrared signal transfer, visible light signal transfer, ultraviolet light signal transfer, wireless signal transfer along the electromagnetic spectrum, or some combination thereof. Output devices 750 may include any ports, plugs, antennae, wired or wireless transmitters, wired or wireless transceivers, or any other components necessary for or usable to implement the communication types listed above, such as cellular Subscriber Identity Module (SIM) cards.

Input devices 760 may include circuitry providing a portion of a user interface. Input devices 760 may include an alpha-numeric keypad, such as a keyboard, for inputting alpha-numeric and other information, or a pointing device, such as a mouse, a trackball, stylus, or cursor direction keys. Input devices 760 may include touch-sensitive surfaces as well, either integrated with a display as in a touchscreen, or separate from a display as in a trackpad. Touch-sensitive surfaces may in some cases detect localized variable pressure or force detection. In some cases, the input device circuitry may allow for receipt of data over an audio jack, a microphone jack, a universal serial bus (USB) port/plug, an Apple® Lightning® port/plug, an Ethernet port/plug, a fiber optic port/plug, a proprietary wired port/plug, a wired local area network (LAN) port/plug, a BLUETOOTH® wireless signal transfer, a BLUETOOTH® low energy (BLE) wireless signal transfer, an IBEACON® wireless signal transfer, a radio-frequency identification (RFID) wireless signal transfer, near-field communications (NFC) wireless signal transfer, dedicated short range communication (DSRC) wireless signal transfer, 802.11 Wi-Fi wireless signal transfer, wireless local area network (WLAN) signal transfer, Visible Light Communication (VLC), Worldwide Interoperability for Microwave Access (WiMAX), Infrared (IR) communication wireless signal transfer, Public Switched Telephone Network (PSTN) signal transfer, Integrated Services Digital Network (ISDN) signal transfer, 3G/4G/5G/LTE cellular data network wireless signal transfer, personal area network (PAN) signal transfer, wide area network (WAN) signal transfer, ad-hoc network signal transfer, radio wave signal transfer, microwave signal transfer, infrared signal transfer, visible light signal transfer, ultraviolet light signal transfer, wireless signal transfer along the electromagnetic spectrum, or some combination thereof. Input devices 760 may include any ports, plugs, antennae, wired or wireless receivers, wired or wireless transceivers, or any other components necessary for or usable to implement the communication types listed above, such as cellular SIM cards.

Input devices 760 may include receivers or transceivers used for positioning of the computing system 700 as well. These may include any of the wired or wireless signal receivers or transceivers. For example, a location of the computing system 700 can be determined based on signal strength of signals as received at the computing system 700 from three cellular network towers, a process known as cellular triangulation. Fewer than three cellular network towers can also be used—even one can be used—though the location determined from such data will be less precise (e.g., somewhere within a particular circle for one tower, somewhere along a line or within a relatively small area for two towers) than via triangulation. More than three cellular network towers can also be used, further enhancing the location's accuracy. Similar positioning operations can be performed using proximity beacons, which might use short-range wireless signals such as BLUETOOTH® wireless signals, BLUETOOTH® low energy (BLE) wireless signals, IBEACON® wireless signals, personal area network (PAN) signals, microwave signals, radio wave signals, or other signals discussed above. Similar positioning operations can be performed using wired local area networks (LAN) or wireless local area networks (WLAN) where locations are known of one or more network devices in communication with the computing system 700 such as a router, modem, switch, hub, bridge, gateway, or repeater. These may also include Global Navigation Satellite System (GNSS) receivers or transceivers that are used to determine a location of the computing system 700 based on receipt of one or more signals from one or more satellites associated with one or more GNSS systems. GNSS systems include, but are not limited to, the US-based Global Positioning System (GPS), the Russia-based Global Navigation Satellite System (GLONASS), the China-based BeiDou Navigation Satellite System (BDS), and the Europe-based Galileo GNSS. Input devices 760 may include receivers or transceivers corresponding to one or more of these GNSS systems.

Display system 770 may include a liquid crystal display (LCD), a plasma display, an organic light-emitting diode (OLED) display, an electronic ink or "e-paper" display, a projector-based display, a holographic display, or another suitable display device. Display system 770 receives textual and graphical information, and processes the information for output to the display device. The display system 770 may include multiple-touch touchscreen input capabilities, such as capacitive touch detection, resistive touch detection, surface acoustic wave touch detection, or infrared touch detection. Such touchscreen input capabilities may or may not allow for variable pressure or force detection.

Peripherals 780 may include any type of computer support device to add additional functionality to the computer system. For example, peripheral device(s) 780 may include one or more additional output devices of any of the types discussed with respect to output device 750, one or more additional input devices of any of the types discussed with respect to input device 760, one or more additional display systems of any of the types discussed with respect to display system 770, one or more memories or mass storage devices or portable storage devices of any of the types discussed with respect to memory 720 or mass storage 730 or portable storage 740, a modem, a router, an antenna, a wired or wireless transceiver, a printer, a bar code scanner, a quick-response ("QR") code scanner, a magnetic stripe card reader, a integrated circuit chip (ICC) card reader such as a smartcard reader or a EUROPAY®-MASTERCARD®-VISA® (EMV) chip card reader, a near field communication (NFC) reader, a document/image scanner, a visible light camera, a thermal/infrared camera, an ultraviolet-sensitive camera, a night vision camera, a light sensor, a phototransistor, a photoresistor, a thermometer, a thermistor, a battery, a power source, a proximity sensor, a laser rangefinder, a sonar transceiver, a radar transceiver, a lidar transceiver, a network device, a motor, an actuator, a pump, a conveyer belt, a robotic arm, a rotor, a drill, a chemical assay device, or some combination thereof.

The components contained in the computer system 700 of FIG. 7 can include those typically found in computer systems that may be suitable for use with some aspects of the subject technology and represent a broad category of such computer components that are well known in the art. That said, the computer system 700 of FIG. 7 can be customized and specialized for the purposes discussed herein and to carry out the various operations discussed herein, with specialized hardware components, specialized arrangements of hardware components, and/or specialized software. Thus, the computer system 700 of FIG. 7 can be a personal computer, a hand held computing device, a telephone ("smartphone" or otherwise), a mobile computing device, a workstation, a server (on a server rack or otherwise), a minicomputer, a mainframe computer, a tablet computing device, a wearable device (such as a watch, a ring, a pair of glasses, or another type of jewelry or clothing or accessory), a video game console (portable or otherwise), an e-book reader, a media player device (portable or otherwise), a vehicle-based computer, another type of computing device, or some combination thereof. The computer system 700 may in some cases be a virtual computer system executed by another computer system. The computer can also include different bus configurations, networked platforms, multiprocessor platforms, etc. Various operating systems can be used including Unix®, Linux®, FreeBSD®, FreeNAS®, pfSense®, Windows®, Apple® Macintosh OS® ("MacOS®"), Palm OS®, Google® Android®, Google® Chrome OS®, Chromium® OS®, OPENSTEP®, XNU®, Darwin®, Apple® iOS®, Apple® tvOS®, Apple® watchOS®, Apple® audioOS®, Amazon® Fire OS®, Amazon® Kindle OS®, variants of any of these, other suitable operating systems, or combinations thereof. The computer system 700 may also use a Basic Input/Output System (BIOS) or Unified Extensible Firmware Interface (UEFI) as a layer upon which the operating system(s) are run.

In some cases, the computer system 700 may be part of a multi-computer system that uses multiple computer systems 700, each for one or more specific tasks or purposes. For example, the multi-computer system may include multiple computer systems 700 communicatively coupled together via at least one of a personal area network (PAN), a local area network (LAN), a wireless local area network (WLAN), a municipal area network (MAN), a wide area network (WAN), or some combination thereof. The multi-computer system may further include multiple computer systems 700 from different networks communicatively coupled together via the internet (also known as a "distributed" system).

Some aspects of the subject technology may be implemented in an application that may be operable using a variety of devices. Non-transitory computer-readable storage media refer to any medium or media that participate in providing instructions to a central processing unit (CPU) for execution and that may be used in the memory 720, the mass storage 730, the portable storage 740, or some combination thereof. Such media can take many forms, including, but not limited to, non-volatile and volatile media such as optical or magnetic disks and dynamic memory, respectively. Some forms of non-transitory computer-readable media include, for example, a floppy disk, a flexible disk, a hard disk, magnetic tape, a magnetic strip/stripe, any other magnetic storage medium, flash memory, memristor memory, any other solid-state memory, a compact disc read only memory (CD-ROM) optical disc, a rewritable compact disc (CD) optical disc, digital video disk (DVD) optical disc, a blu-ray disc (BDD) optical disc, a holographic optical disk, another optical medium, a secure digital (SD) card, a micro secure digital (microSD) card, a Memory Stick® card, a smartcard chip, a EMV chip, a subscriber identity module (SIM) card, a mini/micro/nano/pico SIM card, another integrated circuit (IC) chip/card, random access memory (RAM), static RAM (SRAM), dynamic RAM (DRAM), read-only memory (ROM), programmable read-only memory (PROM), erasable programmable read-only memory (EPROM), electrically erasable programmable read-only memory (EEPROM), flash EPROM (FLASHEPROM), cache memory (L1/L2/L3/L4/L5/L7), resistive random-access memory (RRAM/ReRAM), phase change memory (PCM), spin transfer torque RAM (STT-RAM), another memory chip or cartridge, or a combination thereof.

Various forms of transmission media may be involved in carrying one or more sequences of one or more instructions to a processor 710 for execution. A bus 790 carries the data to system RAM or another memory 720, from which a processor 710 retrieves and executes the instructions. The instructions received by system RAM or another memory 720 can optionally be stored on a fixed disk (mass storage device 730/portable storage 740) either before or after execution by processor 710. Various forms of storage may likewise be implemented as well as the necessary network interfaces and network topologies to implement the same.

While various flow diagrams provided and described above may show a particular order of operations performed by some embodiments of the subject technology, it should be understood that such order is exemplary. Alternative embodiments may perform the operations in a different order, combine certain operations, overlap certain operations, or some combination thereof. It should be understood that unless disclosed otherwise, any process illustrated in any flow diagram herein or otherwise illustrated or described herein may be performed by a machine, mechanism, and/or computing system 700 discussed herein, and may be performed automatically (e.g., in response to one or more triggers/conditions described herein), autonomously, semi-autonomously (e.g., based on received instructions), or a combination thereof. Furthermore, any action described herein as occurring in response to one or more particular triggers/conditions should be understood to optionally occur automatically response to the one or more particular triggers/conditions.

The foregoing detailed description of the technology has been presented for purposes of illustration and description. It is not intended to be exhaustive or to limit the technology to the precise form disclosed. Many modifications and variations are possible in light of the above teaching. The described embodiments were chosen in order to best explain the principles of the technology, its practical application, and to enable others skilled in the art to utilize the technology in various embodiments and with various modifications as are suited to the particular use contemplated. It is intended that the scope of the technology be defined by the claim.

Embodiments of the present disclosure may be provided as a computer program product, which may include a computer-readable medium tangibly embodying thereon instructions, which may be used to program a computer (or other electronic devices) to perform a process. The computer-readable medium may include, but is not limited to, fixed (hard) drives, magnetic tape, floppy diskettes, optical disks, compact disc read-only memories (CD-ROMs), and magneto-optical disks, semiconductor memories, such as ROMs, random access memories (RAMs), programmable read-only memories (PROMs), erasable PROMs (EPROMs), electrically erasable PROMs (EEPROMs), flash memory, magnetic or optical cards, or other type of media/machine-readable medium suitable for storing electronic instructions (e. g., computer programming code, such as software or firmware). Moreover, embodiments of the present disclosure may also be downloaded as one or more computer program products, wherein the program may be transferred from a remote computer to a requesting computer by way of data signals embodied in a carrier wave or other propagation medium via a communication link (e.g., a modem or network connection).

What is claimed is:

1. A method of adaptively controlling traffic movements for driver safety, the method comprising:

capturing visual data of an intersection of a plurality of thoroughfares using a camera, wherein:

the intersection is beyond stop lines for all directions of traffic, the camera is at a fixed location at the intersection, the camera is an omnidirectional camera, and a field of view of the camera at the fixed location includes at least a portion of the intersection;

defining a risk zone and a safe zone associated with the intersection based on the visual data;

surveying vehicular traffic through the intersection visible in the visual data, wherein the risk zone is within the intersection;

identifying that an at-risk vehicle is present in the risk zone based on:

timing of a traffic signal indicator, and the visual data from the camera; and modifying a timing of the traffic signal indicator to change its color to allow the identified at-risk vehicle to pass through the risk zone into the safe zone.

2. The method of claim 1, wherein modifying the timing of the traffic signal indicator to allow the vehicle to pass through the risk zone into the safe zone includes extending a period of time during which the traffic signal indicator outputs a green light.

3. The method of claim 1, wherein modifying the timing of the traffic signal indicator to allow the vehicle to pass through the risk zone into the safe zone includes extending a period of time during which the traffic signal indicator outputs a yellow light.

4. The method of claim 1, wherein modifying the timing of the traffic signal indicator to allow the vehicle to pass through the risk zone into the safe zone includes extending a period of time during which the traffic signal indicator outputs a red light.

5. The method of claim 1, wherein the traffic signal indicator is directed toward vehicular traffic coming from a same one of the plurality of thoroughfares as the at-risk vehicle.

6. The method of claim 1, wherein the traffic signal indicator is directed toward vehicular traffic coming from a different one of the plurality of thoroughfares than the at-risk vehicle.

7. The method of claim 1, wherein the risk zone of the intersection includes an area where at least a subset of the plurality of thoroughfares intersect.

8. The method of claim 1, wherein the risk zone of the intersection includes a center and an area around the center, wherein the area around the center includes a plurality of paths of the vehicular traffic through the intersection visible in the visual data, wherein at least a subset of the plurality of paths intersect.

9. The method of claim 1, wherein the safe zone associated with the intersection includes one or more thoroughfare areas of the plurality of thoroughfares, wherein the one or more thoroughfare areas extend outward from the intersection.

10. The method of claim 1, wherein the safe zone associated with the intersection includes a designated area at a periphery of an area where a subset of the plurality of thoroughfares intersect.

11. The method of claim 1, wherein the safe zone associated with the intersection includes one or more designated areas extending outward from the risk zone, wherein each of the one or more designated areas includes one or more paths along which one or more vehicles in the safe zone travel, the one or more paths parallel to each other.

12. A system for safe adaptive traffic control, the system comprising:

a camera connector coupled to a camera, wherein:

the camera connector receives visual media data of an intersection of a plurality of thoroughfares from the camera, a field of view of the camera includes at least a portion of the intersection, the camera is at a fixed location at the intersection, the camera is an omnidirectional camera, and the intersection is beyond stop lines for all directions of traffic; and a memory that stores instructions;

a processor that executed the instructions, wherein execution of the instructions by the processor:

defines a risk zone and a safe zone associated with the intersection based on the visual data, surveys vehicular traffic through the intersection visible in the visual data, and identifies that an at-risk vehicle is present in the risk zone based on:

timing of a traffic signal indicator, and the visual data from the camera; and a traffic signal indicator connector couples to the traffic signal indicator, wherein:

the risk zone is within the intersection, and the traffic signal indicator connector modifies a timing of the traffic signal indicator to change its color to allow the identified at-risk vehicle to pass through the risk zone into the safe zone.

13. The system of claim 12, wherein the traffic signal indicator modifies the timing of the traffic signal indicator by extending a period of time during which the traffic signal indicator outputs a green light.

14. The system of claim 12, wherein the traffic signal indicator modifies the timing of the traffic signal indicator by extending a period of time during which the traffic signal indicator outputs a yellow light.

15. The system of claim 12, wherein the traffic signal indicator modifies the timing of the traffic signal indicator by extending a period of time during which the traffic signal indicator outputs a red light.

16. The system of claim 12, wherein the risk zone includes an area where the plurality of thoroughfares intersect, and wherein the safe zone includes one or more designated areas extending outward from the risk zone.

17. The system of claim 12, wherein the camera connector is wirelessly coupled to the camera and the traffic signal indicator connector is wirelessly coupled to the traffic signal indicator.

18. A method of safe adaptive traffic control, the method comprising:

capturing visual data of an intersection of a plurality of thoroughfares using a camera;

identifying that a vehicle present in the intersection is at-risk due to a timing of a traffic signal indicator, the identification based on the visual data; and modifying the timing of the traffic signal indicator to allow the vehicle to safely pass through the intersection.

* * * * *